United States Patent [19]

Brannon et al.

[11] Patent Number: 4,978,893

[45] Date of Patent: Dec. 18, 1990

[54] LASER-TRIGGERED VACUUM SWITCH

[75] Inventors: Paul J. Brannon, Albuquerque, N. Mex.; Donald F. Cowgill, Danville, Calif.

[73] Assignee: The United States of American as epresented by the United States the Department of Energy, Washington, D.C.

[21] Appl. No.: 249,815

[22] Filed: Sep. 27, 1988

[51] Int. Cl.[5] ..... H01J 45/00

[52] U.S. Cl. ..... 315/150; 315/111.01; 315/111.81; 313/311; 313/346 R

[58] Field of Search ..... 315/150, 111.01, 111.81; 313/311, 346 R

[56] References Cited

U.S. PATENT DOCUMENTS

| | | | |
|---|---|---|---|
| 3,093,766 | 6/1963 | Cobine | 313/174 |
| 3,303,376 | 2/1967 | Lafferty | 313/148 |
| 3,331,981 | 7/1967 | Lafferty | 313/178 |
| 3,450,922 | 6/1969 | Gallagher | 313/155 |
| 3,465,205 | 9/1969 | Lafferty | 313/330 |
| 3,497,755 | 2/1970 | Horn | 313/311 |
| 4,019,079 | 4/1977 | Hardin | 313/231.4 |
| 4,346,330 | 8/1982 | Lee et al. | 315/150 |
| 4,360,757 | 11/1982 | Hahndorff | 313/575 |

OTHER PUBLICATIONS

A. Makarevich et al., "A Vacuum Spark Gap with Laser Firing", *Instruments and Experimental Techniques, vol. 16, No. 1-6, 1973, pp. 1716-1717.*

V. Bulgin et al., "Laser-Triggered Vacuum Switch", *Sov. Phys. Tech. vol. 20, No. 4, pp. 561-563.*

R. Fellers et al., "A Laser Triggered Vacuum Gap for High Energy Applications", *IEEE Procedures Southeastcon '80, Nashville, Tenn., Apr. 1980, pp. 315-318.*

*Primary Examiner*—Eugene R. Laoche
*Assistant Examiner*—Do Hyun Yoo
*Attorney, Agent, or Firm*—Karla Ojanen; James H. Chafin; William R. Moser

[57] ABSTRACT

A laser-triggered vacuum switch has a material such as a alkali metal halide on the cathode electrode for thermally activated field emission of electrons and ions upon interaction with a laser beam, the material being in contact with the cathode with a surface facing the discharge gap. The material is preferably a mixture of KCl and Ti powders. The laser may either shine directly on the material, preferably through a hole in the anode, or be directed to the material over a fiber optic cable.

18 Claims, 5 Drawing Sheets

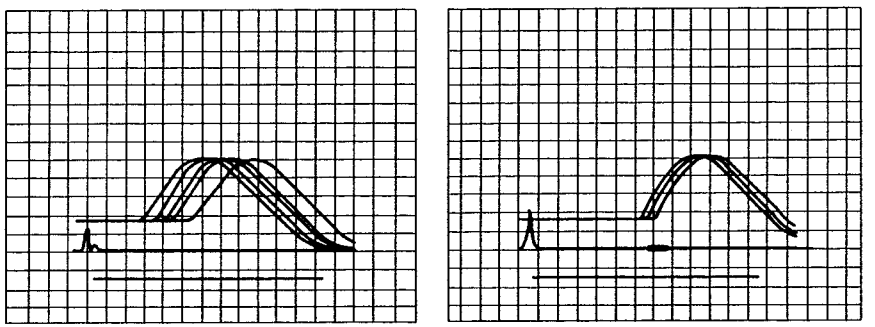
FIG.5a
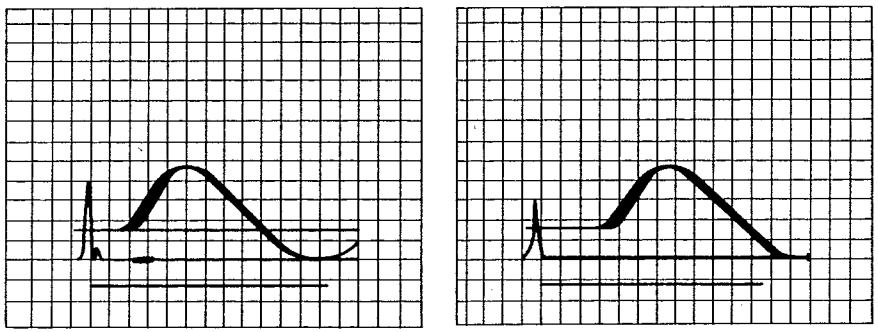
FIG.5b
60 ns/div.
KI/TI PELLET
FIG.5c
(3mm APERTURE)
FIG.5d
(1mm APERTURE)
60 ns/div.
KI/TI PELLET

LASER-TRIGGERED VACUUM SWITCH

The United States Government has rights in this invention pursuant to Contract No. DE-AC04-76DP00789 between the Department of Energy and AT&T Technologies, Inc.

BACKGROUND OF THE INVENTION

Electrically-triggered vacuum switches are a proven technology for switching high electric voltages and currents. These switches can withstand high electric fields on the order of 100 kV/cm, recover rapidly from a switching operation, have turn on times on the order of 100 ns, and are triggerable at relatively low voltages. They can be made physically small, and they do not require a cathode heating current as does a gas-filled thyratron.

Two disadvantages of electrically-triggered vacuum switches are their susceptibility to accidental switching because of spurious electromagnetic pulse signals, and their jitter times.

Jitter time refers to the time period over which a switch may close after the firing signal is applied. For many applications, it is necessary to minimize jitter time in order that the event caused by the closing of the switch may be initiated at a desired time.

The time delay, or wait time, to the firing of electrically-triggered vacuum switches is defined as the elapsed time between the application of the trigger pulse and the initiation of the main discharge. The collapse time is the time it takes after initiation of the main discharge for the voltage across the main gap to fall to a minimum. This time is dependent upon the impedance of the switch, and can be reduced by minimizing switch inductance, capacitance, and resistance. Collapse times of 10 to 30 ns have been reported, while delay times are typically 50 to 1000 ns. The collapse time is generally constant; the jitter time is about 10 to 30 percent of the delay time. Therefore, for a switch with a collapse time of 20 ns and a delay time of 500 ns, the switch contacts could be expected to close anytime between 420 to 520 ns after the application of the trigger pulse. This variation in closing time may be too great if the switch is controlling one of a predetermined sequence of events.

Laser-triggered vacuum switches have been developed in an effort to reduce jitter time. A. Makarevich et al., "A Vacuum Spark Gap with Laser Firing", *Instruments and Experimental Techniques*, Vol. 16, Nos. 1–6, 1973, discloses a laser-triggered switch where up to 40 kV was switched across a 5 mm gap with a switching time of about 9 ns and a mean-square deviation in switching times for 10 pulses of about 1.5 ns. V. Bulygin et al., *Sov. Phys. Tech. Phys.*, Vol. 20, No. 4, 1975, pp. 561–563, discloses a switch having two titanium disk electrodes with a gap of 1.8 mm where a 10 ns laser pulse is focussed through an aperture in one electrode to the other electrode. This paper notes that the anode is the preferable target electrode, and that the laser pulse should be on the order of 20 ns with an energy greater than 2.5 mJ.

R. Fellers et al., "A Laser Triggered Vacuum Gap for High Energy Applications", *IEEE Proc. Southeastcon '80*, 1980, pp. 315–318, discloses a laser triggered switch which proposes coating the electrodes with mercury that would be vaporized by the arc, yet would condense back on the electrodes after the arc. The mercury is expected to form a plasma to quicken the gap breakdown. The Fellers switch requires about 2 joules of laser energy to activate the switch and operates because a plasma is generated at the metal surface by the high laser flux densities incident thereon.

SUMMARY OF THE INVENTION

It is an object of this invention to provide a laser-triggered vacuum switch that discharges with a relatively low power trigger pulse.

It is another object of this invention to provide a laser-triggered vacuum switch having a solid material on the gap cathode for thermally activated field emission of electrons and ions upon interaction with a laser beam.

It is a further object of this invention to provide a laser-triggered vacuum switch having a pellet consisting of a mixture of KCl and Ti on the gap cathode.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the present invention may comprise a laser-triggered vacuum switch comprising a hermetically sealed evacuated envelope; an anode electrode within and insulated from the envelope and connected to a positive voltage to be switched; and a cathode electrode within and insulated from the envelope and the anode and connected to a negative voltage to be switched, the cathode being spaced from the anode by a discharge gap. A solid material for thermally activated field emission of electrons and ions upon interaction with a laser beam is in contact with the cathode. One surface of this material faces the discharge gap, and means are also provided for conducting a laser beam to the solid material, wherein electrons and ions released by the material upon contact of a laser beam result in a plasma breakdown across the discharge gap, thereby closing the switch.

BRIEF DESCRIPTION OF THE DRAWINGS

The accompanying drawings, which are incorporated in and form part of the specification, illustrate an embodiment of the present invention and, together with the description, serve to explain the principles of the invention.

FIGS. 5*a*–5*d* show the jitter and delay performance for two pellets and two apertures.

DETAILED DESCRIPTION OF THE INVENTION

Figure 1:
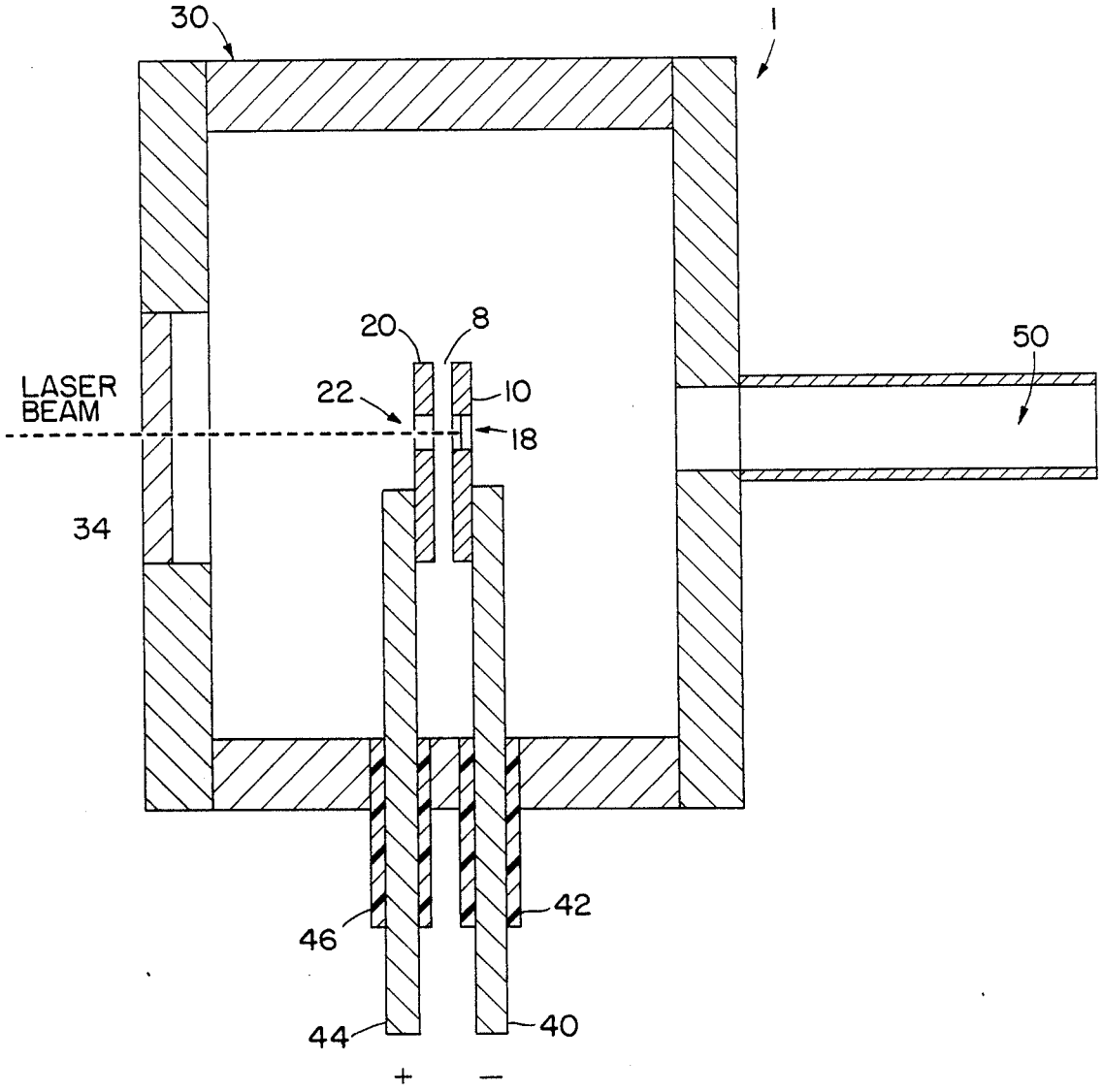
FIG. 1 shows a cutaway view of a switch in accordance with a first embodiment of this invention.

FIG. 1 shows a laser-triggered vacuum switch 1 in accordance with a preferred embodiment of this invention to include a hermetically sealed metal envelope 30 having a port 50 for connection to a vacuum pump for creation of a vacuum within envelope 30. The vacuum approximately $5\times10^{-8}$ torr may be maintained by either sealing port 50 of evacuated envelope 30, or by keeping the vacuum pump connected to port 50.

Contained within envelope 30 are a pair of spaced, opposed, molybdenum electrodes: cathode 10 and anode 20. Cathode 10 is mounted to a copper feedthrough 40 extending through and insulated from envelope 30 within an insulating sleeve 42. Anode 20 is mounted to a copper feedthrough 44 extending through and insulated from envelope 30 within an insulating sleeve 46. In operation, the exterior ends of feedthroughs 44 and 40 are connected to the negative and positive sides, respectively, of the voltage to be switched.

In the embodiment of FIG. 1, a laser beam for triggering the switch enters envelope 30 through a sapphire laser window 34. An aperture 22 in anode 20 is aligned with window 34 in order that the beam may extend across the gap 8 between the electrodes. A solid material, shown as pellet 18, preferably consisting of a mixture of KCl and Ti powders, is affixed to cathode 10 in alignment with the path of the laser beam through anode aperture 22. In operation, the laser beam is focussed on pellet 18, causing emission of particles that enhance the breakdown of the voltage across cathode 10 and anode 20, as discussed hereinafter.

Figure 2:
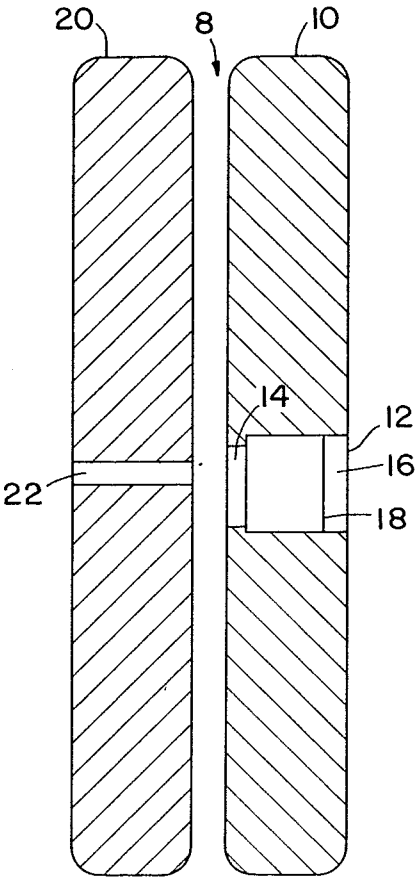
FIG. 2 shows a detail cutaway view of the electrodes of the switch of FIG. 1.

FIG. 2 shows the preferred electrode configuration for the embodiment of FIG. 1. Cathode 10 includes an aperture 12 axially aligned with aperture 22 of anode 20. Aperture 12 includes a first opening 14 of a first diameter extending from the surface of cathode 10 facing gap 8, and a second opening 16 of a second, greater, diameter axially aligned with the first opening and extending to the opposite surface of cathode 10. Pellet 18, with a diameter equal to the diameter of second opening 16, is placed within second opening 16 with a surface adjacent the first opening.

The preferred embodiment of pellet 18 was compressed from equal weights of powdered KCl (300 microns diameter) and Ti (8 microns diameter). Other tests were made by substituting either KI of CsI for KCl. The use of any alkali metal halide is contemplated with this invention, in combination with Ti or other metal carriers. Chromium, aluminum, and tungsten were also tested as carrier materials; titanium provided the best results.

Figure 3B:
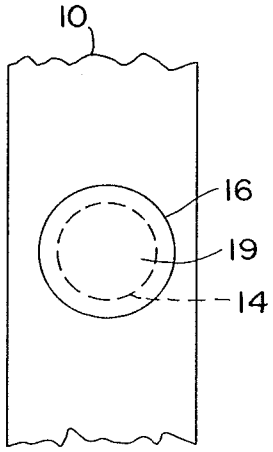
FIGS. 3*a* and 3*b* show partial views of additional embodiments of the cathode construction of the invention.
Figure 3A:
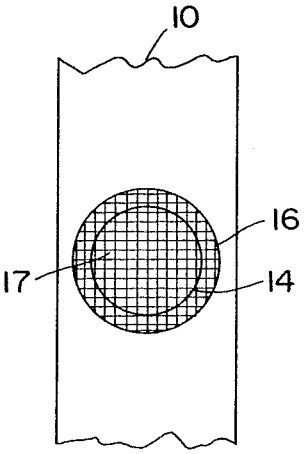

FIG. 3*a* shows the configuration of cathode 10 for additional tests where either a one mil nickel mesh or a 250 micron stainless steel wire mesh 17, sized to fit within second opening 16 adjacent first opening 14, was substituted for the Ti powder, the alkali metal halide being melted around the mesh. The larger nickel mesh was not as satisfactory as the smaller stainless steel mesh because the alkali metal halide did not bond well to the nickel, and because it was more difficult to direct the laser beam to hit the larger mesh.

FIG. 3*b* shows other embodiments which involved a thin coat of alkali metal halide evaporated on either stainless steel or Ti sheet stock 19 fitted within opening 16.

The invention was tested using an apparatus described in P. Brannon et al., "Low Jitter Laser-Triggered High-Voltage Vacuum Switch Using Low Laser Energies", Sandia Report SAND87-1997, October 1987, the disclosure of this apparatus being incorporated herein by reference. In brief, a 532 or 1060 nm laser beam was obtained from a Quanta Ray DCR2 laser and harmonic doubler. After spatial filtering, the nearly Gaussian shaped beam was directed through a reducing telescope to increase the peak irradiance on the pellet to 1-5 $MW/cm^2$. A photographic shutter was used to select a single pulse from the pulsed DCR2 laser train of 15-20 ns-wide pulses at 10 pulses/sec. The spatial profile of the beam was determined using a Reticon RL 1728HG000 linear array.

For these tests, anode 20 and cathode 10 were each 25 mm diameter polished molybdenum with a gap space 8 of 0.5 mm. The diameter of second opening 16 and pellet 18 was 4 mm; the diameter of first opening 14 was 3 mm. The diameter of anode opening 22 was either 3 mm or 1 mm.

The jitter time and amount of energy needed to trigger switch 1 is strongly dependent upon the position of pellet 18 relative to the surface of cathode 10 facing gap 8; e.g., the length of first opening 14. With a KCl/Ti pellet as described above and a recess of 0.5 mm, the energy needed for triggering switch 1 was only 20 uJ (peak power density of 1 $MW/cm^2$). When the pellet recess was increased to 4 mm, the energy needed for triggering the switch increased to 2 mJ (peak power density of 100 $MW/cm^2$). The jitter and delay times also increased with the larger recess.

The operation of the invention is believed to be as follows: the laser beam heats the titanium with the pellet to cause thermally activated field emission of negative particles (electrons and ions) as a result of an interaction between the laser beam and the pellet material, followed by a current buildup resulting from an ion regeneration mechanism. The negative particles initially emitted from the cathode strike the anode, causing the emission of positive ions which, in turn, strike the pellet to cause the emission of more negative ions and electrons. The process continues this repetition with a consequent buildup of the current (electron and ion) across the gap, eventually closing the switch. The energy necessary to generate sufficient plasma for switch closure comes primarily from the electric field, and not the laser beam.

The advantage of the invention over prior art devices which focus laser energy directly on a metal cathode is that most of the energy needed to produce the electron flow in the invention comes from the electric field applied across the electrodes, and the energy does not have to come from the laser. As a result, the invention switched with 20 uJ of laser energy, while the prior art requires more than a joule of laser energy.

Figure 4:
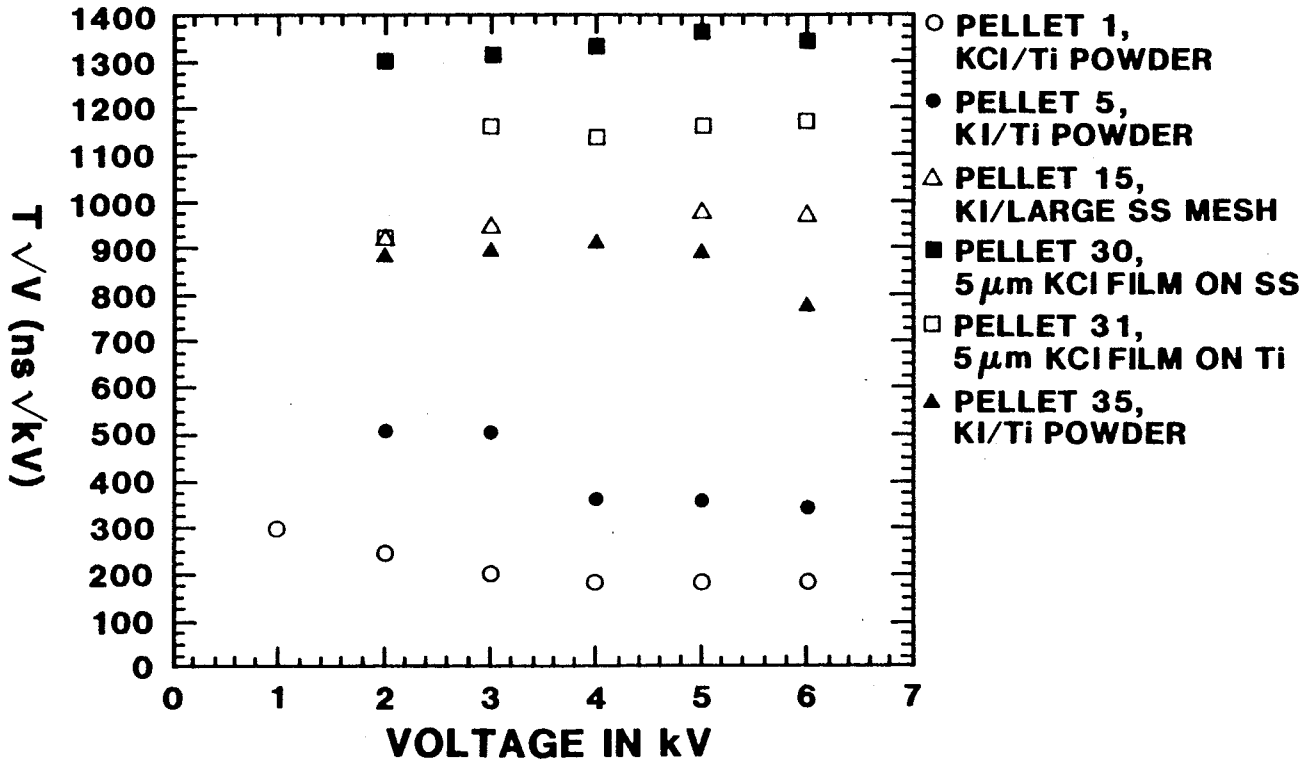
FIG. 4 shows the performance of the switch of the invention with several different pellets.

If the equation of motion of an ion in an electric field is solved, it can be shown that $T(V)^{\frac{1}{2}}=\text{constant}$, where T is the discharge time delay (ns) and V is the gap voltage (kV). FIG. 4 shows that the different pellets discussed above each provide a constant $T(V)^{\frac{1}{2}}$ as a function of gap voltage. These results are an indication that the theoretical explanation of the operation of the invention is correct, as this explanation assumes T to be a multiple of a single transit time, with the number of transits required for breakdown being a function of the pellet material. The results also show that the KCl/Ti pellet has the least delay time.

The tests made with the two laser frequencies gave similar results, indicating that the initial trigger mechanism is not strongly wavelength dependent and does not involve multiphoton processes. These results are also consistent with a thermal mechanism.

FIGS. 5a–5d show results of multiple firings of a switch of the invention with a KCl/Ti powder pellet (FIGS. 5a and 5b), a KI/Ti pellet (FIGS. 5c and 5d), a 3 mm opening 22 in anode 20 (FIGS. 5a and 5c), and a 1 mm opening 22 (FIGS. 5b and 5d). In each of these figures, the upper curves show the voltage across a 0.005 ohm dropping resistor in series with the gap and a capacitor, while the lower curves show an electrical representation of the applied laser pulse. The delay time is defined as the time from the laser pulse to the time where the upper curve voltage is measurable; a time coinciding with the time an arc begins to form across gap 8. The curves show delay and jitter to be less with a smaller opening 22 than a larger opening. The curves also shows delay to be less for KCl/Ti than for KI/Ti. In addition, the energy required to trigger the switch is reduced with the smaller opening 22. This result is also consistent with the ion regeneration model of operation, since ion feedback would be greater for a 1 mm opening than a 3 mm opening. With the smaller aperture, more negative ions generated at cathode 10 are captured by anode 20 for regeneration as positive ions. With a larger aperture, more of the negative ions pass through the aperture, and are not regenerated at the cathode.

The shorter delay time for KCl/Ti than for KI/Ti noted in FIGS. 4 and 5 also suggests that delay time is a function of transit time. Since an ion derived from KI is expected to be heavier than an ion derived from KCl, the transit time of a KI ion would be longer than for a KCl ion.

Figure 6:
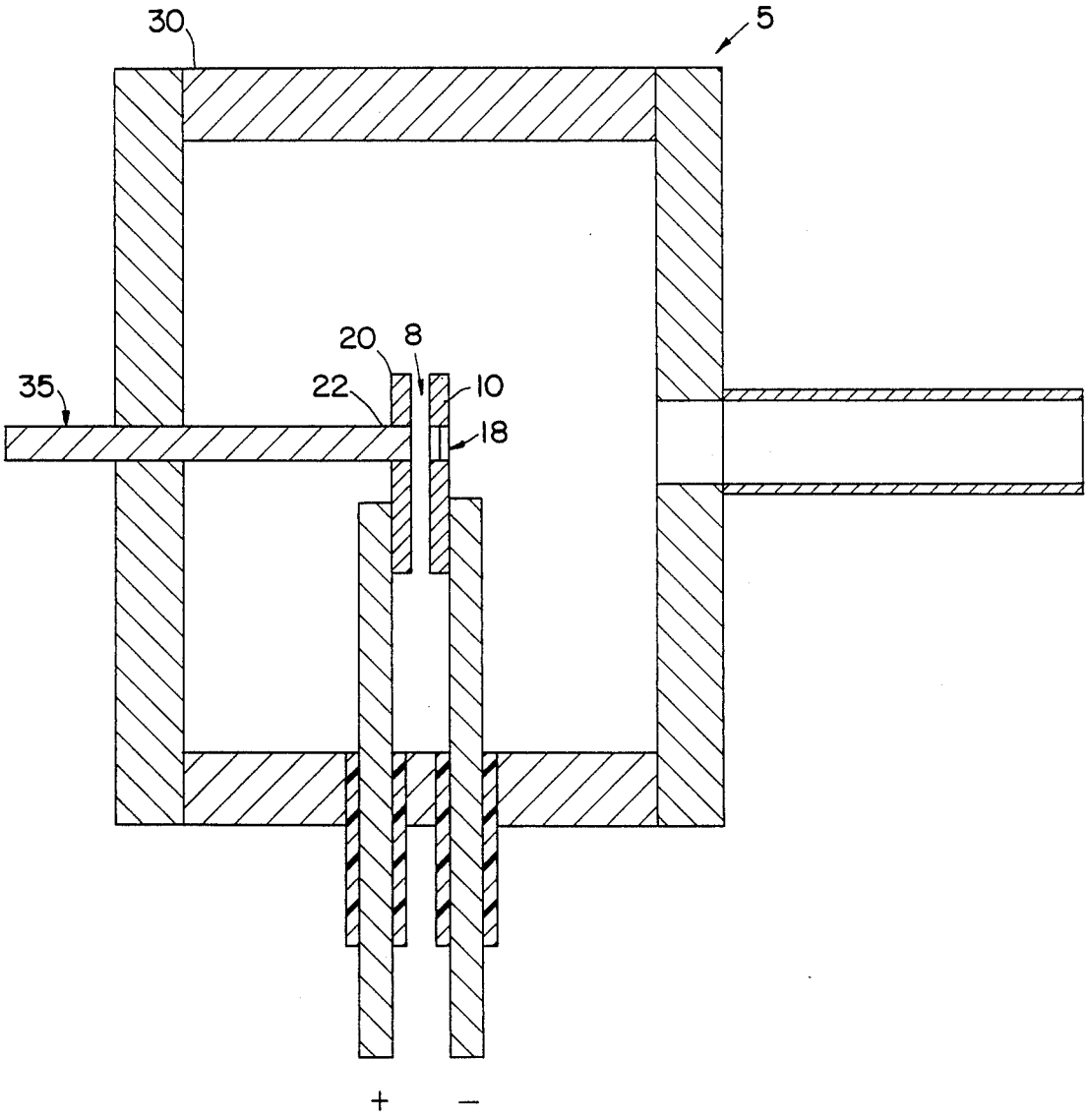
FIG. 6 shows a cutaway view of a switch in accordance with a second embodiment of this invention.

FIG. 6 shows a second embodiment of the construction of switch of the invention. The switch 5 of this embodiment is identical to switch 1 of FIG. 1 except for the provision of alternate means for coupling the laser beam to the electrode gap. For this embodiment, the laser window 34 of switch 1 has been omitted, and a fiber optic cable 35 has been added. Cable 35 extends through envelope 30 to a location where its interior end is operatively coupled across gap 8 to pellet 18. Preferably, cable 35 is connected to aperture 22 in anode 20. The exterior end of cable 35 is coupled to a laser in a manner well known in the art.

It should be understood that cable 35 may have any orientation both within and outside of envelope 30, as optic cables carry light around curved paths as is well known in the art. Accordingly, this embodiment allows unlimited flexibility in placing the laser with respect to the switch.

It is further contemplated that the laser could be a laser diode mounted within enclosure 30. Such an embodiment could also use a short piece of fiber optic cable to carry the beam from the laser to gap 8.

The particular sizes and equipment discussed above are cited merely to illustrate a particular embodiment of this invention. It is contemplated that the use of the invention may involve components having different sizes and shapes as long as the principle of using a material that produces thermally actuated ions and electrons on a laser actuated switch cathode is followed. It is intended that the scope of the invention be defined by the claims appended hereto.

We claim:

1. A laser-triggered vacuum switch comprising:

a hermetically sealed evacuated envelope;

an anode electrode within and insulated from said envelope and connected to a positive voltage to be switched;

a cathode electrode within and insulated from said envelope and insulated from said anode and connected to a negative voltage to be switched, said cathode being spaced from said anode by a discharge gap;

solid material means for thermally activated field emission of electrons and ions upon interaction with a laser beam, said material being in contact with said cathode with a surface facing the discharge gap; and means for conducting a laser beam to said solid material;

wherein electrons and ions released by said material upon contact of a laser beam result in a plasma breakdown across the discharge gap, thereby closing said switch.

2. The laser-triggered vacuum switch of claim 1 wherein said solid material consists of a combination of an alkali-metal halide and a carrier metal.

3. The laser-triggered vacuum switch of claim 2 wherein said combination is a mixture of KCl and Ti.

4. The laser-triggered vacuum switch of claim 3 wherein said mixture consists of at least approximately equal parts by weight of KCl and Ti powders.

5. The laser-triggered vacuum switch of claim 2 wherein said combination consists of an alkali-metal halide coated on a carrier metal sheet.

6. The laser-triggered vacuum switch of claim 1 wherein said means for conducting a laser beam includes an opening through said anode aligned with said solid material.

7. The laser-triggered vacuum switch of claim 6 wherein said means for conducting a laser beam further includes a window in said envelope, wherein the laser beam is conducted through said window and said opening to said material.

8. The laser-triggered vacuum switch of claim 1 wherein the means for conducting a laser beam to said solid material comprises a fiber optic cable having one end connectable to a laser.

9. The laser-triggered vacuum switch of claim 8 wherein said means for conducting a laser beam includes an opening through said anode aligned with said solid material, with said fiber optic cable being disposed within said opening.

10. A laser-triggered vacuum switch comprising:

a hermetically sealed evacuated envelope;

an anode electrode within and insulated from said envelope and connected to a positive voltage to be switched;

a cathode electrode within and insulated from said envelope and insulated from said anode and connected to a negative voltage to be switched, said cathode being spaced from said anode by a discharge gap;

solid material means further comprising an alkali-metal halide melted around a carrier metal mesh for thermally activated field emission of electrons and ions upon interaction with a laser beam, said material being in contact with said cathode with a surface facing the discharge gap; and means for conducting a laser beam to said solid material;

wherein electrons and ions released by said material upon contact of a laser beam result in a plasma breakdown across the discharge gap, thereby closing said switch.

11. A laser-triggered vacuum switch comprising:

a hermetically sealed evacuated envelope;

an cathode electrode within and insulated from said envelope and connected to a negative voltage to be switched, said cathode having a first opening which extends into said cathode and faces a discharge gap;

an anode electrode within and insulated from said envelope and insulated from said cathode and connected to a positive voltage to be switched, said anode being spaced from said cathode by the discharge gap;

solid material means being disposed within said first opening of said cathode for thermally activated field emission of electrons and ions upon interaction with a laser beam, said material being in contact with said cathode with a surface facing the discharge gap; and means for conducting a laser beam to said solid material;

wherein electrons and ions released by said material upon contact of a laser beam result in a plasma breakdown across the discharge gap, thereby closing said switch.

12. The laser-triggered vacuum switch of claim 11 wherein said means for conducting a laser beam includes a second opening through said anode aligned with said solid material.

13. The laser-triggered vacuum switch of claim 12 wherein said means for conducting a laser beam further includes a window in said envelope, wherein the laser beam is conducted through said window and said second opening to said material.

14. The laser-triggered vacuum switch of claim 11 wherein said first opening comprises:

a first portion of a first diameter extending into a surface of said cathode facing the discharge gap; and a second portion of a second diameter greater than the first diameter, said second portion extending coaxially with and from said first portion to a surface of said cathode opposite the discharge gap.

15. The laser-triggered vacuum switch of claim 14 wherein said material is a pellet of a second diameter within said second portion of said first opening.

16. The laser-triggered vacuum switch of claim 15 wherein said material consists of a mixture of KCl and Ti.

17. The laser triggered vacuum switch of claim 16 wherein said mixture consists of at least approximately equal parts by weight of KCl and Ti powders.

18. The laser triggered vacuum switch of claim 14 wherein the minimum diameter of said first portion is less than the diameter of said second portion of said first opening.

* * * * *